US006265362B1

(12) United States Patent
Loderer et al.

(10) Patent No.: US 6,265,362 B1
(45) Date of Patent: Jul. 24, 2001

(54) LUBRICATING GREASE COMPOSITION

(75) Inventors: Dirk Loderer, Gilching; Dieter Sohn, Ammersee; Herbert Kardinal, Zorneding, all of (DE)

(73) Assignee: Klüber Lubrication München KG, München (DE)

( * ) Notice: Subject to any disclaimer, the term of this patent is extended or adjusted under 35 U.S.C. 154(b) by 0 days.

(21) Appl. No.: 09/207,311

(22) Filed: Dec. 7, 1998

Related U.S. Application Data

(63) Continuation of application No. PCT/EP97/02927, filed on Jun. 5, 1997.

(30) Foreign Application Priority Data

Jun. 7, 1996 (DE) ..... 196 22 906

(51) Int. Cl.[7] ..... C10M 169/00; C10M 16/02
(52) U.S. Cl. ..... 508/485; 508/582
(58) Field of Search ..... 508/485, 582

(56) References Cited

U.S. PATENT DOCUMENTS 5,000,864 * 3/1991 Strepparola et al. ..... 508/582
5,145,591 * 9/1992 Kinoshita et al. ..... 508/582
5,376,289 * 12/1994 Montagna et al. ..... 508/582
5,435,927 * 7/1995 Beckwith et al. ..... 508/582

FOREIGN PATENT DOCUMENTS

0657524A * 6/1995 (EP) .

* cited by examiner

*Primary Examiner*—Jacqueline V. Howard
(74) *Attorney, Agent, or Firm*—Kubovcik & Kubovcik

(57) ABSTRACT

A lubricating grease composition that is a mixture of (a) a hydrocarbon-based oil, (b) a perfluoro-polyalkyl ether oil of the formula $$A'—(O—CF_2)_v—(O—C_2F_4)_w—(O—C_3F_6)_x—(O—C_4F_8)_y—(O—CF_2CF(CF_3))_z—O—A''$$

in which

A' is $—CF_3$, $—C_2F_5$, $—C_3F_7$, or $—CF_2T$ where T is H or Cl,

A" is A' or $—CF_3$, $C_2F_5$, $—C_3F_7$, or $—CF_2T$, where T is H or $Cl_1$ and v, w, x, y and z are whole numbers $\geqq 0$, (c) a dicarbamide as a thickening agent, (d) typical additives and (e) organic and inorganic solid lubricants.

A process for the production of the lubricating grease composition is also provided.

10 Claims, No Drawings

LUBRICATING GREASE COMPOSITION

This application is a continuation of International Application PCT/EP97/02927 filed Jun. 5, 1997.

BACKGROUND OF THE INVENTION

1. Field of the Invention

The invention relates to lubricating grease compositions made from a base oil mixture that consists of a hydrocarbon oil and a perfluoro-polyalkyl ether oil, and a small portion of thickening agent based on a dicarbamide composition, as well as typical additives. The compositions have an especially good noise dampening effect at operating temperatures of from 180° C. to 250° C. This invention also relates to a process for the production of these lubricating grease compositions.

2. Description of Related Art

The development of new lubricating greases must be compatible with the overall further development of technology, which places new and higher requirements on lubricating grease compositions. The known lubricating greases, based on mineral or synthetic oils, no longer measure up to these requirements.

Lubricating greases have application in vehicle technology, materials handling technology, machinery construction, office technology, and in industrial systems and machinery, as well as in the areas of household appliances and consumer electronics.

In roller bearings, lubricating greases assure that a separating, load-transferring film of grease is formed between parts that slide against or roll upon one another. The load-transferring film of grease prevents contact so that no wear occurs. Therefore, the lubricants must satisfy various requirements, among which are:

(a) extreme operating conditions such as very high and very low rotational speeds and loads, (b) high temperatures that are caused by high rotational speeds and loads or by outside heat sources, (c) very low temperatures due to low self-heating of the bearing in a cold environment or by intensive heat loss to the cold environment, (d) special demands of the user on the operating characteristics, for example, low friction, low noise, the demand for extremely long operating times without periodic re-lubrication, (e) unfavorable ambient conditions and defective sealing of a bearing, and (f) dynamic effect on the grease, for example, centrifugal force, gravity, vibrations.

An important parameter for a long service life of a grease-lubricated bearing in the high temperature range is, aside from the maximum operating temperature according to DIN 51825, the noise aspects of the lubricant. A lubricating grease can, with circulation (rolling over, stretching), cause vibrations ("lubricant noises") in the roller bearing that occur in the medium (300 to 1800 Hz) and high (1800 to 10,000 Hz) frequency bands, as compared with the low frequency band, 50 to 300 Hz. The lubricant noise is superimposed on the noise peaks that result due to shock pulses on the bearing ring when the roller elements roll over hard particles. The evaluation of the noise aspect is performed according to the SKF-Bequiet-Method, which is based on the statistical assessment of the noise surges and their assignment to noise classes BQ1 to BQ4. The noise aspect and the service life of the roller bearings worsen with increasing value of the noise class (H. Werries, E. Paland, FVA-studies on the subject "low-noise lubricating grease" University of Hannover 1994). Thus 100% noise class BQ1 is characterized as very good, and low percentage values exclusively in noise class BQ4 are characterized as very poor noise aspect. The better the noise aspect of a lubricating grease, the less the vibrations of the bearing induced by the grease. This is equivalent to lower loading of the roller bearings and longer service life of the bearing.

A lubricant composition which includes a base oil, such as trimethylolpropane pelargonate, pentaerythritol pelargonate, polyphenyl ether, perfluoroalkyl ether and mixtures thereof, with a thickening agent such as a di- or polycarbamide, is disclosed in U.S. Pat. No. 5,512,188. The dicarbamide can be produced from a diisocyanate and an amine such as octyl amine or aniline. Furthermore, the lubricating grease composition can contain boron nitride or polytetrafluoroethylene (solid lubricants) and additives.

Lubricating greases based on a petroleum oil, or on a synthetic hydrocarbon-based oil, mixed with a perfluoro-polyalkyl ether thickened with an organic or an inorganic thickener, are described in European Patent Application EP-A 0 657 524.

The weight ratio of lubricating oil and perfluoro-polyalkyl ether/thickener lie in the range from 97:3 to 80:20 and the ratio of lubricating oil/perfluoro-polyalkyl ether lies in the range of 95:5 to 60:40. With these lubricating oils and added perfluoro-polyalkyl ether components, the operating time is extended at an operating temperature of 170° C. to 175° C.

Low-noise lubricating greases based on thermally stable polyphenyl ethers, alkylated phenyl ethers, polyolesters and aromatic carboxylic acids, thickened with 5 to 30% by weight of di- and/or polycarbamides are disclosed in U.S. Pat. No. 5,145,591. They can be used at high operating temperatures over 180° C. according to DIN 51825. For operating temperatures greater than 180° C., at present, lubricating greases completely based on perfluoro-polyalkyl ethers, thickened with PTFE, inorganic thickeners, such as bentonites, aerosols or metallic soaps, or metal complex soaps, must be used for operating temperatures above 180° C.

The invention seeks to provide a lubricating grease composition that meets the requirements listed above, is usable in particular under high temperature conditions, and has a very good noise aspect and long operating life, and causes essentially no appearance of wear of the roller bearing.

SUMMARY OF THE INVENTION

A lubricating grease composition is prepared according to the invention, which is a mixture of a hydrocarbon-based oil, a perfluoro-polyalkyl ether oil and a dicarbamide as a thickening agent, as well as typical additives.

DETAILED DESCRIPTION

The hydrocarbon-based oil is produced from an ester of an aromatic di-, tri- or tetracarboxylic acid, with one or more $C_7$- to $C_{22}$-alcohols, a polyphenyl ether or alkylated polyphenyl ether, an ester of trimethylolpropane, pentaerythritol or dipentaerythritol with aliphatic $C_7$- to $C_{22}$-carboxylic acids, $C_8$-dimer acid esters with $C_7$- to $C_{22}$-alcohols, and complex esters, as individual components or in any mixture.

The perfluoro-polyalkyl ethers of the lubricating grease compositions according to the present invention have the general formula $$A'—(O—CF_2)_v—(O—C_2F_4)_w—(O—C_3F_6)_x—(O—C_4F_8)_y—(O—$$

$CF_2CF(CF_3))_z—O—A''$ in which

A' is $—CF_3$, $—C_2F_5$, $—C_3F_7$, or $—CF_2T$, where T is H or Cl,

A" is A' or $—CF_3$, $—C_2F_5$, $—C_3F_7$, or $—CF_2T$, wherein T is H or Cl, and v, w, x, y and z are whole numbers ≧0.

Preferred chain components are $—(CF(CF_3)CF_2O)_z—$, $—(CF(CF_3)CF_2O)_z—(CF_2O)_v$, where z/v is approximately 40/1, $—(CF_2CF_2O)_w—(CF_2O)_v—$, where w/v is approximately 3/2 and $—(CF_2CF_2O)_w—(CF_2O)_v—$, where w/v is approximately 2/3.

The perfluoro-polyalkyl ether oils used preferably in the lubricating grease compositions according to the present invention are thermally stable oils with low rates of evaporation at 200° C. such as commercially available Aflunox, Fomblin, Krytox or Demnum oils. The lubricating grease compositions that satisfy the requirements in the high temperature range can only be produced with perfluoro-polyalkyl ether oils.

The thickening agent is a reaction product from a diisocyanate, preferably 2,4-toluene diisocyanate, 2,6-toluene diisocyanate, 4,4'-diphenylmethane diisocyanate, 4,4'-diphenyl diisocyanate, 3,3'-dimethyldiphenyl-4,4'-diisocyanate, and 3,3'-dimethyldiphenylmethane-4,4'-diisocyanate, individually or mixed, and an amine of the general formula $(H_2N)_xR$, where x=1 and R is an alkyl or alkylene group with 6 to 22 carbon atoms or an aryl radical with 6 to 12 carbon atoms, individually or mixed.

Moreover, the lubricating grease compositions according to the present invention contain typical additives against corrosion, oxidation and for protection against metal influences, which operate as chelate compounds, radical scavengers, UV-converters, reaction layer formers and the like.

The lubricating grease compositions according to the present invention are mixed in a ratio of greater than 60/40 of hydrocarbon-based oil to perfluoro-polyalkyl ether oil, thickened with 5 to 30% by weight of the dicarbamide compound, and contain up to 10% by weight additives and/or up to 10% by weight of organic or inorganic solid lubricants. These solid lubricants can be, for example, polyimides, PTFE, graphite, metal oxides, boron nitride, molybdenum disulfide or phosphates.

In these compounded lubricating greases, the viscosity of the hydrocarbon-based oil is in a range of from 100 to 500 $mm^2/s$ and that of the perfluoro-polyalkyl ether oil is in a range of from 10 to 1500 $mm^2/s$.

Moreover, the lubricating grease compositions have dropping points greater than 240° C. according to DIN ISO 2176, and are suited for high operating temperatures up to 250° C. according to DIN 51825.

The lubricating grease compositions according to the present invention are obtained either by mixing the hydrocarbon-based oil thickened with dicarbamide with the perfluoro-polyalkyl ether oil and then homogenizing the mixture using a high pressure homogenizer, or by mixing the hydrocarbon-based oil with the perfluoro-polyalkyl ether oil and thickening it by synthesis of the dicarbamide compound in this mixture and then homogenizing it using a high pressure homogenizer and/or three-roller mill.

The invention is now explained in greater detail through the following examples.

EXAMPLES

Example 1 (B1)

120.8 g of a mixture of 2,4- and 2,6-toluene diisocyanate were reacted with 129.9 g aniline in 700 g of a dialkylphenyl ether oil, in which the alkyl radical has 8 carbon atoms. After the exothermic reaction stopped, the product was heated to 160° C. During cooling, 20 g of a commercially available antioxidant, 20 g of a commercially available wear protection additive and 10 g of a commercially available corrosion protection agent were added. Next 667 g of a perfluoro-polyalkyl ether with a viscosity of 200 $mm^2/s$ at 40° C. were added. The grease was homogenized by a single high pressure homogenization and a subsequent rolling on a three-roll mill. In this way, a grease of the NLGI-Class 2 according to DIN ISO 2137 was obtained. The grease obtained in this way was tested on a noise test stand. Compared to commercially available lubricating greases, an especially low noise aspect was measured.

Example 2 (B2)

78.7 g of diphenylmethane-isocyanate were reacted with 81.3 g octyl amine in a two phase mixture of 800 g ester oil consisting of an ester of trimellitic acid and an alcohol mixture of $C_8$- and $C_{10}$-alcohols, with 1000 g of perfluoro-polyalkyl ether having a viscosity of 400 $mm^2/s$ at 40° C., in the same manner as in Example 1. 40 g of commercially available additives was added and the mixture was homogenized by repeated rolling on a three-roller mill. In this way, a grease of the NLGI-Class 2 according to DIN ISO 2137 with especially low-noise behavior was obtained.

Example 3 (B3)

The lubricating grease composition was produced as in Example 2, with the exception that the prepared oil mixture consisted of 800 g of ester oil and 800 g of perfluoro-polyalkyl ether. In this way, a grease of the NLGI-Class 2 according to DIN ISO 2137 with especially low noise behavior was obtained.

Example 4 (BL)

The lubricating composition was produced as in Example 2, with the exception that the prepared oil mixture consisted of 800 g of ester oil and 500 g of perfluoro-polyalkyl ether. In this way, a grease of the NLGI-Class 2 according to DIN ISO 2137 with especially low noise behavior was obtained.

Example 5 (B5)

The lubricating grease composition was produced as in Example 2 with the exception that the prepared oil mixture consisted of 800 g of ester oil and 200 g of perfluoro-polyalkyl ether. In this way, a grease of the NLGI-Class 2 according to DIN ISO 2137 with especially low noise behavior was obtained.

Example 6 (B6)

The lubricating grease composition was produced as in Example 2 with the exception that no perfluoro-polyalkyl ether was added to the 800 g of ester oil. In this way, a grease of the NLGI-Class 2 according to DIN ISO 2137 with especially low noise behavior was obtained.

Example 7 (B7)

The lubricating grease composition was produced as in Example 6, with the exception that, instead of the 800 g of ester oil made up of trimellitic acid and $C_8$- and $C_{10}$-alcohols, 800 g of ester oil made up of pyromellitic acid and $C_8$- and $C_{10}$-alcohols were used.

Example 8 (B8; Comparative Example)

A commercially available product made of polyalkyl ether (PFPE) thickened with polytetrafluorethylene (PTFE).

The following tables show the properties of the lubricants of Examples 1 through 8.

Table 1 shows the measurements from noise testing of the lubricating grease compositions produced according to Examples 1 through 8 as specified by DIN ISO 2137.

TABLE 1

| Lubricating grease | B1 | B2 | B3 | B4 | B5 | B6 | B6 | B7 | B8 |
|---|---|---|---|---|---|---|---|---|---|
| FAG FE-9, DIN T2 Test temperature (° C.) (A, 6000, 1500) | 220 | 220 | 220 | 220 | 220 | 200 | 180 | 200 | 240 |
| Run time $L_{50}$ Weinbull | 156 | 210 | 142 | 81 | 56 | 20 | 530 | 113 | 83 |
| NLGI-Class (DIN ISO 2176) | 2 | 2 | 2 | 2 | 2 | 2 | 2 | 2 | 2 |
| Drop point (DIN ISO 2176) | >240 | >240 | >240 | >240 | >240 | >240 | | >240 | ca. 170 |
| Noise class SFK-Bequiet | | | | | | | | | |
| % BQ1 | 39 | 94 | 89 | 90 | 85 | 88 | | 99 | 0 |
| % BQ2 | 82 | 98 | 98 | 98 | 97 | 96 | | 100 | 5 |

The weight ratios of the lubricating grease compositions of Examples 1 through 8 are specified in Table 2.

TABLE 2

| Lubricating grease | B1 | B2 | B3 | B4 | B5 | B6 | B7 | B8 |
|---|---|---|---|---|---|---|---|---|
| % by weight of hydrocarbon-based lubricating oil | 42 | 40 | 44.4 | 53.4 | 66.6 | 80 | 80 | 0 |
| % by weight of consistency agents and additives | 18 | 10 | 11.2 | 13.3 | 16.7 | 20 | 20 | 20 |
| % by weight of perfluoro-polyalkyl ether oil | 40 | 50 | 44.4 | 33.3 | 16.7 | 0 | 0 | 80 |

The mixture ratios of hydrocarbon-based oil and perfluoro-polyalkyl ether oil are given in Table 3.

TABLE 3

| Lubricating grease | B1 | B2 | B3 | B4 | B5 | B6 | B7 | B8 |
|---|---|---|---|---|---|---|---|---|
| % by weight of hydrocarbon-based lubricating oil | 51.2 | 44.4 | 50 | 61.6 | 80 | 100 | 100 | 0 |
| % by weight of perfluoro-polyalkyl ether oil | 48.8 | 55.6 | 50 | 38.4 | 20 | 0 | 0 | 100 |

Tables 1 and 2 show that the lubricating grease B6, based on an ester oil that was thickened with dicarbamide, exceeds by a factor of 5 the requirements at a high operating temperature of 180° C. according to DIN 51825. However, it does not come close to satisfying the criterion of an $L_{50}$-operating time of at least 100 hours according to DIN 51825 on the FAG FE-9 bearing test machine at 200° C. The criterion of a high operating temperature of 200° C. is satisfied only with thermally very stable dicarbamide greases based on pyromellitic acid esters (B7). Table 3 shows that a high operating temperature of 220° C. according to DIN 51825 is only reached through addition of perfluoro-polyalkyl ether oil, if the mass portion of perfluoro-polyalkyl ether in an oil mixture of lubricating hydrocarbon-based oil lies at over 40% by weight.

Furthermore, it is evident from Table 1 that the lubricating grease compositions according to the invention show a better noise aspect than a commercially available lubricating grease composition (comparative example B8).

What is claimed is:

1. A lubricating grease composition comprising a mixture of (a) a hydrocarbon-based oil, which is an ester of an aromatic tri- or tetracarboxylic acid with one or more $C_7$- to $C_{22}$-alcohols, a polyphenyl ether or alkylated polyphenyl ether, an ester of trimethylolpropane, pentaerythritol or dipentaerythritol with an aliphatic $C_7$- to $C_{22}$-carboxylic acid, $C_{18}$-dimer acid ester with a $C_7$- to $C_{22}$-alcohol, or a complex ester, as an individual component or as a mixture, (b) a perfluoro-polyalkyl ether oil of the formula $$A'—(O—CF_2)_v—(O—C_2F_4)_w—(O—C_3F_6)_x—(O—C_4F_8)_y—(O—CF_2CF(CF_3))_z—O—A''$$

in which

A' is $—CF_3$, $—C_2F_5$, $—C_3F_7$, or $—CF_2T$, where T is H or Cl,

A" is A' or $—CF_3$, $—C_2F_5$, $—C_3F_7$, or $—CF_2T$, where T is H or Cl, and v, w, x, y and z are whole numbers $\geqq O$, (c) a dicarbamide as a thickening agent, which is the reaction product of a di-isocyanate and an amine of the formula $(H_2N)_xR$, whereby R is an alkyl radical with 6 to 22 carbon atoms or an aryl radical with 6 to 12 carbon atoms and x is 1, (d) a conventional grease additive and (e) an organic or inorganic solid lubricant selected from the group consisting of polyimides, PTFE, graphite, metal oxides, boron nitride, molybdenum disulfide and phosphates.

2. A lubricating grease composition according to claim 1, wherein the mixture ratio of the hydrocarbon oil to perfluoro-polyalkyl ether oil is greater than 60/40, the amount of dicarbamide is 5 to 30% by weight, the amount of additive is up to 10% by weight and the amount of organic or inorganic solid lubricants is up to 10% by weight.

3. A lubricating grease composition according to claim 1, wherein the viscosity of the hydrocarbon-based oil is within the range from 10 to 500 $mm^2/s$ and that of the perfluoro-polyalkyl ether oil from 10 to 1500 $mm^2/s$.

4. A lubricating grease composition according to claim 2, wherein the viscosity of the hydrocarbon-based oil is within the range from 10 to 500 $mm^2/s$ and that of the perfluoro-polyalkyl ether oil from 10 to 1500 $mm^2/s$.

5. A lubricating grease composition according to claim 1, where the dropping point according to DIN ISO 2176 is greater than 240° C.

6. A lubricating grease composition according to claim 2, where the dropping point according to DIN ISO 2176 is greater than 240° C.

7. A lubricating grease composition according to claim 3, where the dropping point according to DIN ISO 2176 is greater than 240° C.

8. A lubricating grease composition according to claim 4, where the dropping point according to DIN ISO 2176 is greater than 240° C.

9. A process for preparing a lubricating grease composition comprising thickening a hydrocarbon-based oil, which is an ester of an aromatic tri- of tetracarboxylic acid, with one or more $C_7$- to $C_{22}$-alcohols, a polyphenyl ether or aklylated polyphenyl ether, an ester of trimethylolpropane, pentaerythritol or dipentaerythritol with an aliphatic $C_7$- to $C_{22}$-carboxylic acids, $C_{18}$-dimer acid ester with $C_7$- to $C_{22}$-alcohols, or complex esters, as an individual component or as a mixture, with a dicarbamide that is the reaction product of a di-isocyanate and an amine of the general formula $(H_2N)_xR$, whereby R is an alkyl radical with 6 to 22 carbon atoms or an aryl radical with 6 to 12 carbon atoms and x is 1; mixing the thickened hydrocarbon-based oil with a perfluoro-polyalkyl ether oil of the formula $$A'—(O—CF_2)_v—(O—C_2F_4)_w—(O—C_3F_6)_x—(O—C_4F_8)_y—(O—CF_2CF(CF_3))_z—O—A''$$

in which

A' is $—CF_3$, $—C_2F_5$, $—C_3F_7$, or $—CF_2T$, where T is H or Cl,

A" is A' or $—CF_3$, $—C_2F_5$, $—C_3F_7$, or $—CF_2T$, where T is H or Cl, and v, w, x, y and z are whole numbers $\geqq 0$; and homogenizing the resultant mixture with a high pressure homogenizer and/or a three-roller mill.

10. A process for preparing a lubricating grease composition comprising mixing a hydrocarbon-based oil, which is an ester of an aromatic tri- or tetracarboxylic acid, with one or more $C_7$- to $C_{22}$-alcohols, a polyphenyl ether or alkylated polyphenyl ether, an ester of trimethylolpropane, pentaerythritol or dipentaerythritol with an aliphatic $C_7$- to $C_{22}$-carboxylic acids, a $C_{18}$-dimer acid ester with $C_7$- to $C_{22}$-alcohols, or complex esters, as an individual component or as a mixture, with a perfluoro-polyalkyl ether oil of the formula $$A'—(O—CF_2)_v—(O—C_2F_4)_w—(O—C_3F_6)_x—(O—C_4F_8)_y—(O—CF_2CF(CF_3))_z—O—A''$$

in which

A' is $—CF_3$, $—C_2F_5$, $—C_3F_7$, or $—CF_2T$, where T is H or Cl,

A" is A' or $—CF_3$, $—C_2F_5$, $—C_3F_7$, or $—CF_2T$, where T is H or Cl, and v, w, x, y and z are whole numbers $\geqq 0$; thickening a resultant mixture by synthesis therein of a dicarbamide, that is the reaction product of a di-isocyanate and an amine of the general formula $(H_2N)_xR$, whereby R is an alkyl radical with 6 to 22 carbon atoms or an aryl radical with 6 to 12 carbon atoms and X is 1; and homogenizing a thickened mixture with a high pressure homogenizer and/or a three-roller mill.

* * * * *